United States Patent [19]

Bartenstein

[11] 4,022,141

[45] May 10, 1977

[54] MACHINE FOR SEAMING TOGETHER A LID AND A CONTAINER

[75] Inventor: Michael F. Bartenstein, Proctor, Vt.

[73] Assignee: Vermont Marble Company, Proctor, Vt.

[22] Filed: Sept. 9, 1975

[21] Appl. No.: 611,623

[52] U.S. Cl. ..... 113/58; 113/24 A; 113/116 A

[51] Int. Cl.[2] ..... B21D 51/32

[58] Field of Search ..... 113/58, 23 D, 24 R, 113/24 A, 24 D, 24 E, 25, 116 A, 120 K, 120 V

[56] References Cited

UNITED STATES PATENTS

| | | | |
|---|---|---|---|
| 1,639,552 | 8/1927 | Brenzinger | 113/24 E |
| 1,929,339 | 10/1933 | Troyer et al. | 113/24 A X |
| 1,989,518 | 1/1935 | Hopkins | 113/24 A |
| 2,540,611 | 2/1951 | Fawcett et al. | 113/24 R |
| 2,907,293 | 10/1959 | Peterson | 113/24 R |

*Primary Examiner*—Leon Gilden
*Attorney, Agent, or Firm*—Bacon & Thomas

[57] ABSTRACT

Open containers are fed along a shelf into position under a lid dispenser, which places a lid thereon. The containers with their lids are then clamped one at a time to a chuck head, and a seamer apparatus is rotated about the lid and container to seam them together. The seamer apparatus includes oppositely disposed pairs of seaming rollers carried by brackets that are slidably mounted on a rotating frame member, the brackets being operated by individual hydraulic cylinders which move the seamer rollers into and out of engagement with the lids and their containers. A key feature of the invention is that the pressure exerted by the hydraulically operated seaming rollers is fully adjustable, as is the speed of their movement about the periphery of the lid.

12 Claims, 14 Drawing Figures

2
4
5
8
12
14
16
18
22
24
28
30
32
34
36
38
40
44
54
56
78
80
82
84
90
92
134
142
148
154
155
156
162
164
168
170
172
174
176
178
180
182
192
204
232
236
266
268
270
272

Fig. 4.
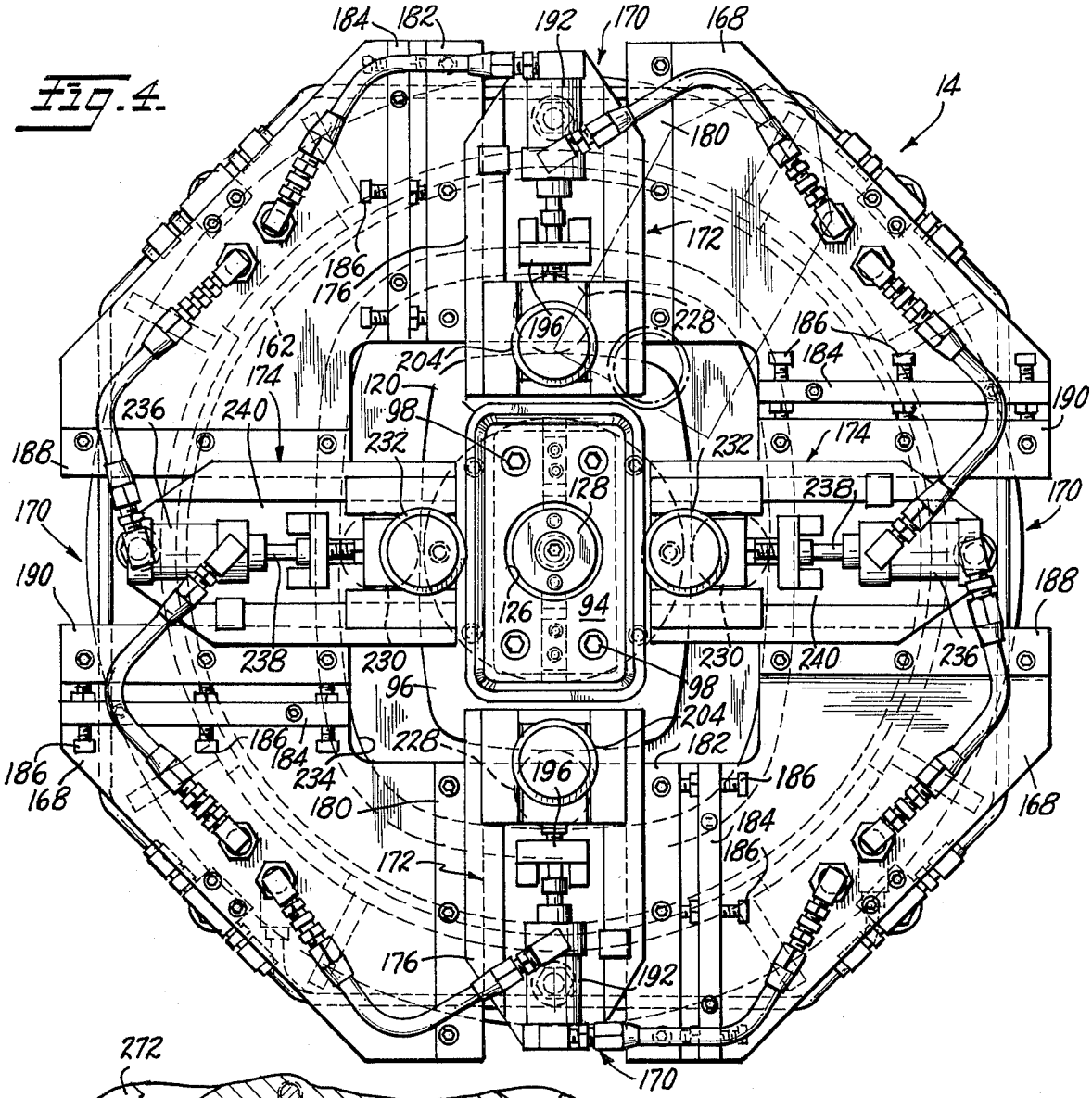
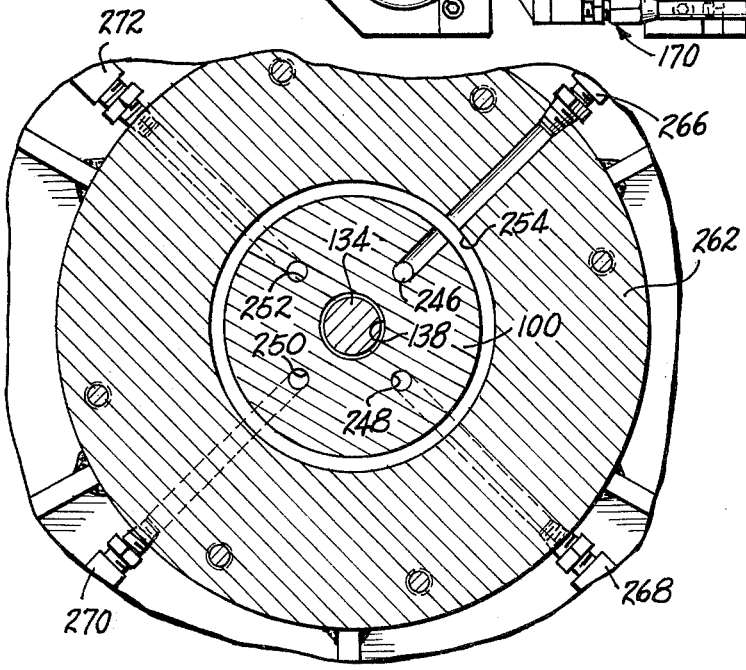
Fig. 6.

MACHINE FOR SEAMING TOGETHER A LID AND A CONTAINER

BACKGROUND OF THE INVENTION

1. Field of the Invention

The present invention relates generally to apparatus for securing a lid to the open end of a metal container. More specifically, it relates to a machine for seaming lids to open cans using seaming rollers that are hydraulically actuated and cam guided, and which provide an adjustable seaming pressure.

2. Description of the Prior Art

It has become a common method of packaging both liquid and solid materials to place such in a metalic container, and to then close the container with a metalic lid that is joined to the container and sealed by a seam. Often the contents of such a sealed metallic container are vacuum packed, as in the case of foodstuffs, in particular.

Machines have been devised to make the seam between the lid and the container, a typical such machine being that shown in U.S. Pat. No. 2,907,293. The practice has been to utilize seaming rollers that are mechanically mounted to follow cams, the cams serving to mechanically move the seaming rollers along a fixed path and with a fixed application pressure into progressively tighter engagement with the lid and its container, until the desired seam has been formed.

These seaming machines of the past are obviously functional, and are in widespread use. However, several problems are often encountered in their use. For example, it is normally not possible to adjust the seaming roller pressure or speed in such devices, where the movement of the seaming rollers is dependent on a mechanical linkage. This can prove a problem when different thicknesses or kinds of metal are used for the container and lid, for the pressure needed or the allowable speed of seam formation in one instance to form a seam may be too great in another instance, and can cause collapse or destruction of the container.

Another problem with many current seaming machines is that complicated mechanical linkages are involved, which over time tend to wear to the point where malfunctions occur, and extensive repairs and replacement of parts must be undertaken. Such repairs can involve considerable downtime and expense, which is compounded by the losses due to the machine being out of service for an extended period.

There is a need for a seaming machine that is simply designed so that parts can be easily replaced, which is fully and easily adjustable in operation to accomodate different containers and lids, and which will generally avoid the operational problems encountered with conventional seaming machines utilizing cam driven seaming rollers. The present invention is intended to satisfy that need.

SUMMARY OF THE INVENTION

The machine of the present invention is designed to take open containers, place lids thereon, seam together the container and its lid, and then transfer the sealed container away from the machine. It is adaptable to accepting both circular and rectangular sheet metal containers, with a change in the operating head and its associated cam track.

The containers to be closed are fed into the machine of the invention on a conveyor, and are then picked up singly and carried along a shelf by a feed mechanism having projecting fingers thereon which engage the container. The containers are first fed to a lid feeding station, where lids are dropped one at a time by a multiple screw feeding apparatus from a storage rack. The open containers with lids placed thereon are then transferred to a hydraulically operated base plate, mounted on the upper end of a piston.

The base plate piston is operated to elevate the base plate with the container thereon, to engage the lid and the upper end of the container against a chuck head. Thereafter, a rotating frame revolves about the chuck head, the frame carrying oppositely disposed pairs of seaming rollers thereon.

The seaming rollers are carried by brackets each having a roller cam follower thereon, the roller cam followers being received in a cam track provided in a guide plate fixed above the rotating frame. The cam followers and their track serve to move the seaming roller brackets about the periphery of the container in a fixed path, either rectangular or circular, depending upon the cross-sectional shape of the container. Unlike in past seaming machines, the cam track and the followers are not utilized to generate seaming pressure, but only serve a guiding function.

Each of the seaming rollers is mounted on a slide, which in turn is mounted for reciprocal movement in a track formed by the mounting bracket and confronting guide plates secured to the bracket by screws. A double-acting hydraulic cylinder is mounted on each bracket in alignment with the track thereof, and the piston of the cylinder is connected with its associated slide. Thus, the seaming rollers are individually reciprocatable, being operated by their individual hydraulic cylinder.

After the container and its lid has been elevated and clamped between the base plate and the chuck head, the rotating frame carrying the seaming rollers is rotated about the chuck head. A first pair of opposed seaming rollers is then operated, the hydraulic cylinders thereof being actuated to move the seaming rollers into engagement with the lid with sufficient pressure to form the first portion of a double joining seam. It is important to note that the seaming pressure is easily adjusted simply by controlling the hydraulic pressure supplied to the hydraulic cylinders, and that the speed of travel for the seaming rollers is easily controlled merely by controlling the rotational speed of the mounting frame. Thus, a much greater control over the seaming operation is possible than in past machines, relying on fixed mechanical linkages.

When the first step in forming the double joining seam has been completed the first pair of opposed seaming rollers is retracted, and then the seaming rollers of the other pair are actuated to complete the double seam. Again, the pressure applied thereby is easily controlled, as is the time period of application. When the seaming operation is complete, the second set of seaming rollers is also retracted, and the base plate piston is then retracted. At the same time, a knockout piston carried centrally of the chuck head is actuated to ensure freeing of the sealed container from the head, thereby completing an operating cycle. The feeding apparatus of the machine is then effective to move the closed and sealed container further along the shelf and out of the seaming machine.

It is the principal object of the present invention to provide a machine for seaming a lid to a container, wherein the seaming pressure can be adjusted at will, and the speed of operation of the seaming rollers can also be adjusted to whatever is desired.

Another object is to provide a seaming machine utilizing seaming rollers that are hydraulically actuated, for precision controlled seaming operations.

A further object is to provide a seaming machine including a transfer means for moving containers therethrough, and a lid dispenser effective to place a single lid on each container from a rack containing a stack of lids.

Yet another object is to provide a seaming machine designed with a minimum of moving parts, and so that all parts can be easily removed and replaced in such a manner as to minimize machine downtime.

Other objects and many of the attendant advantages of the present invention will become readily apparent from the following Description of the Preferred Embodiments, when taken together with the accompanying drawings.

BRIEF DESCRIPTION OF THE DRAWINGS

FIG. 4 is an enlarged bottom plan view of the seamer assembly, taken on the line 4—4 of FIG. 2, and showing in particular the centrally positioned chuck head, the rotating frame, and the two sets of slidably mounted seaming rollers carried by the rotating frame;

FIG. 6 is an enlarged fragmentary horizontal sectional view, taken on the line 6—6 of FIG. 5, and illustrating the hydraulic flow channels of the central supporting shaft and of the sleeve mounting the rotating frame;

DESCRIPTION OF THE PREFERRED EMBODIMENTS

Figure 1:
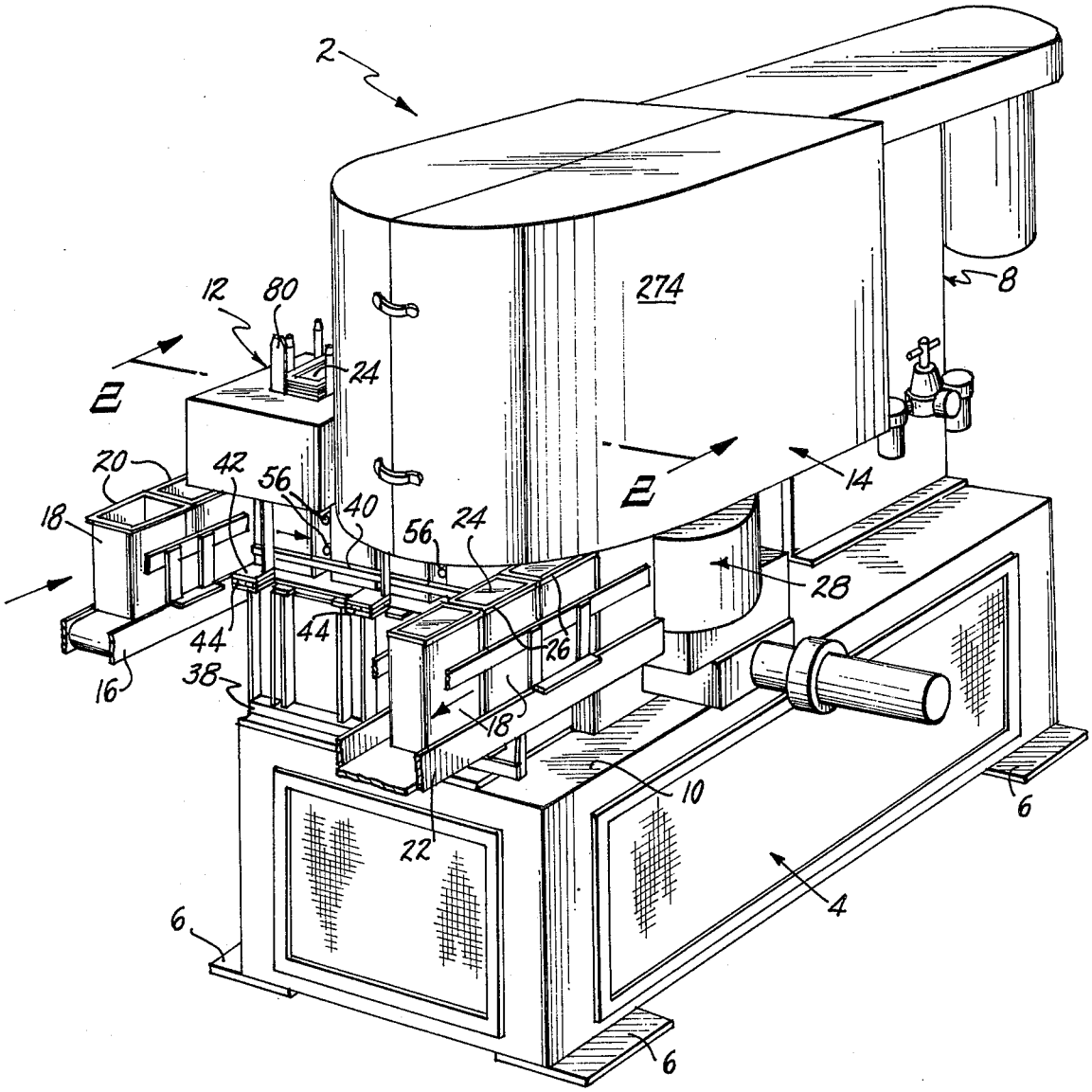
FIG. 1 is a pictorial view of the machine of the present invention, showing open metallic containers feeding into one side thereof, and sealed containers with lids thereon issuing from the outlet side of the machine.

Referring now to FIGS. 1–11 of the drawings, the seaming machine of the invention is indicated generally at 2, and includes a base frame 4 having foot plates 6 thereon that are adapted to rest on a floor, and an upright frame structure 8 that projects above the working bed 10 of the machine 2 and which supports a lid dispensing apparatus 12 and a seam forming assembly 14. A conveyor 16 functions to feed open, generally rectangular containers 18 into the machine 2, each container 18 having a peripheral external flange 20 formed on its open upper end. A discharge tray 22 is positioned at the discharge end of the machine 2, and carries containers 18 to which lids 24 have been secured by a double seam joint 26. A continuous transfer assembly 28 extends from the conveyor 16 to the discharge tray 22, and functions to move the containers 18 through the machine 2.

The containers 18 are fed from the conveyor 16 onto a shelf 30 that is mounted to the working bed 10 of the machine 2 so that it can be vertically adjusted. The front edge of the shelf 30 has downwardly-extending vertical supporting plates 32 secured thereto, each having a pair of vertical slots 34 therein for receiving bolts 36 carried by an upright bracket 38 mounted on the working bed 10. By loosening the bolts 36, the height of the shelf 30 can be adjusted to accommodate containers 18 of different height.

Figure 3:
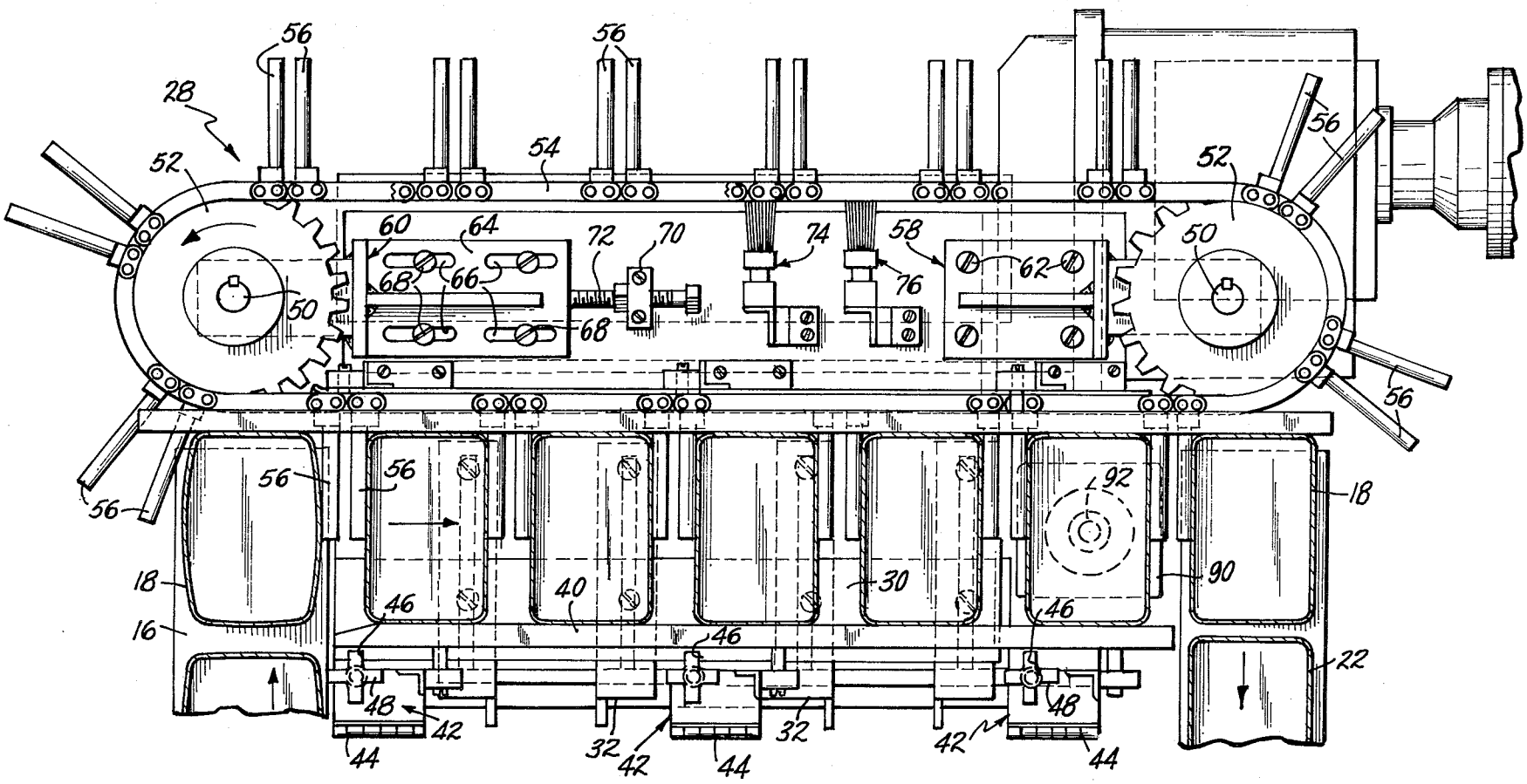
FIG. 3 is a fragmentary plan view of the container body transfer mechanism of the machine, taken on the line 3—3 of FIG. 2, and showing how the projecting fingers mounted on the endless chain function to grasp and carry the individual containers.

The containers 18 are prevented from sliding forwardly off the shelf 30 by a guide bar 40 carried by L-shaped brackets 42, the brackets 42 being secured to the forward edge of the shelf 30 by hinges 44. Thus, should it be necessary to remove a container 18 from the machine 2 during operation thereof, the guide bar 40 can be swung upwardly and outwardly out of the way to give access to the containers 18 being carried through the machine by the transfer assembly 28. As best shown in FIG. 3, the base portions of the brackets 42 have slots 46 therein, and are normally secured in their closed position by turnbuckles 48 mounted on the shelf 30. When it is desired to open the guide bar 40, the turnbuckles 48 are merely rotated 90°, until they are aligned with their associated slots 46.

The transfer mechanism 28 includes a pair of vertical shafts 50, each mounting a pair of spaced sprocket wheels 52 thereon. Endless chains 54 are carried by the upper and lower sprocket wheels 52, and have spaced pairs of outwardly projecting fingers 56 mounted thereon. As shown in FIG. 3, as a container 18 is moved by the conveyor 16 to the transfer assembly 28, it is picked up and carried between two spaced pairs, or a set, of the fingers 56. As shown in FIG. 3, the sidewalls of the generally rectangular containers 18 are normally bowed as the containers approach the machine 2. The spacing between the engaging surfaces of each four fingers 56 belonging to a finger set is such as to ensure a firm grasp on the container 18, and some straightening of the sidewalls thereof. Each set of four fingers 56 is spaced apart from the adjacent set, so that the containers 18 move through the machine 2 with a predetermined and fixed spacing therebetween.

It will be understood that the transfer assembly 28 is operated by applying power to rotate at least one of the vertical shafts 50. The shafts 50 are carried by the vertical portions of L-shaped mounting brackets 58 and 60, the base portion of the bracket 58 being fixed to the machine base 4 by bolts 62. The base portion 64 of the bracket 60 has parallel, elongated slots 66 therein for receiving bolts 68 that are threaded into machine base 4, the slots 66 providing for tensioning of the endless chains 54. A tension block 70 is fixed in place, and carries a tension bolt 72 that engages the rear edge of the base 64 of the bracket 60. Upper and lower lubrication units 74 and 76, respectively, are mounted between the brackets 58 and 60, and are effective to lubricate the endless chains 54.

Turning now to the assembly 12 for dispensing the lids 24 one at a time, such is positioned above the shelf 30 at the first station inwardly from the conveyor 16, and includes a rack 78 having upwardly extending guides 80 thereon, the rack 78 being carried by the upper frame portion 8 of the machine 2. Mounted beneath the rack 78 are four circular feed discs 82 each having a thread on the periphery thereof, the thread on each feed disc 82 being such that it will accept and feed one lid 24 during each operating cycle thereof. The four feed discs 82 are mounted on the lower end of shafts, the upper ends of said shafts being interconnected by a timing chain 84 that is driven such that it will discharge a lid 24 each time a container 18 is positioned directly thereunder on the shelf 30. The mechanism for accomplishing such operation automatically is known to the art, and hence will not be further described herein.

It should be noted that each of the lids 24 has a central, generally rectangular depression 86 therein such that it will fit easily into the upper, open end of its associated container 18. Surrounding the depression 86 is a peripheral lip 88 that has a width about twice that of the flange 20, as is shown in FIGS. 8–11.

The containers 18 with lids 24 thereon are moved from the station beneath the lid dispenser 12 by the transfer assembly 28, the fingers 56 carrying each container 18 along the shelf 30 until it is disposed over a base plate 90 mounted on the upper end of a hydraulic piston 92. The hydraulically operated base plate 90 is disposed directly beneath a chuck head 94 that is a part of the seam forming assembly 14, and is moved upwardly hydraulically to clamp the lid 24 and its associated container 18 against the lower face of the chuck head 94.

Figure 5:
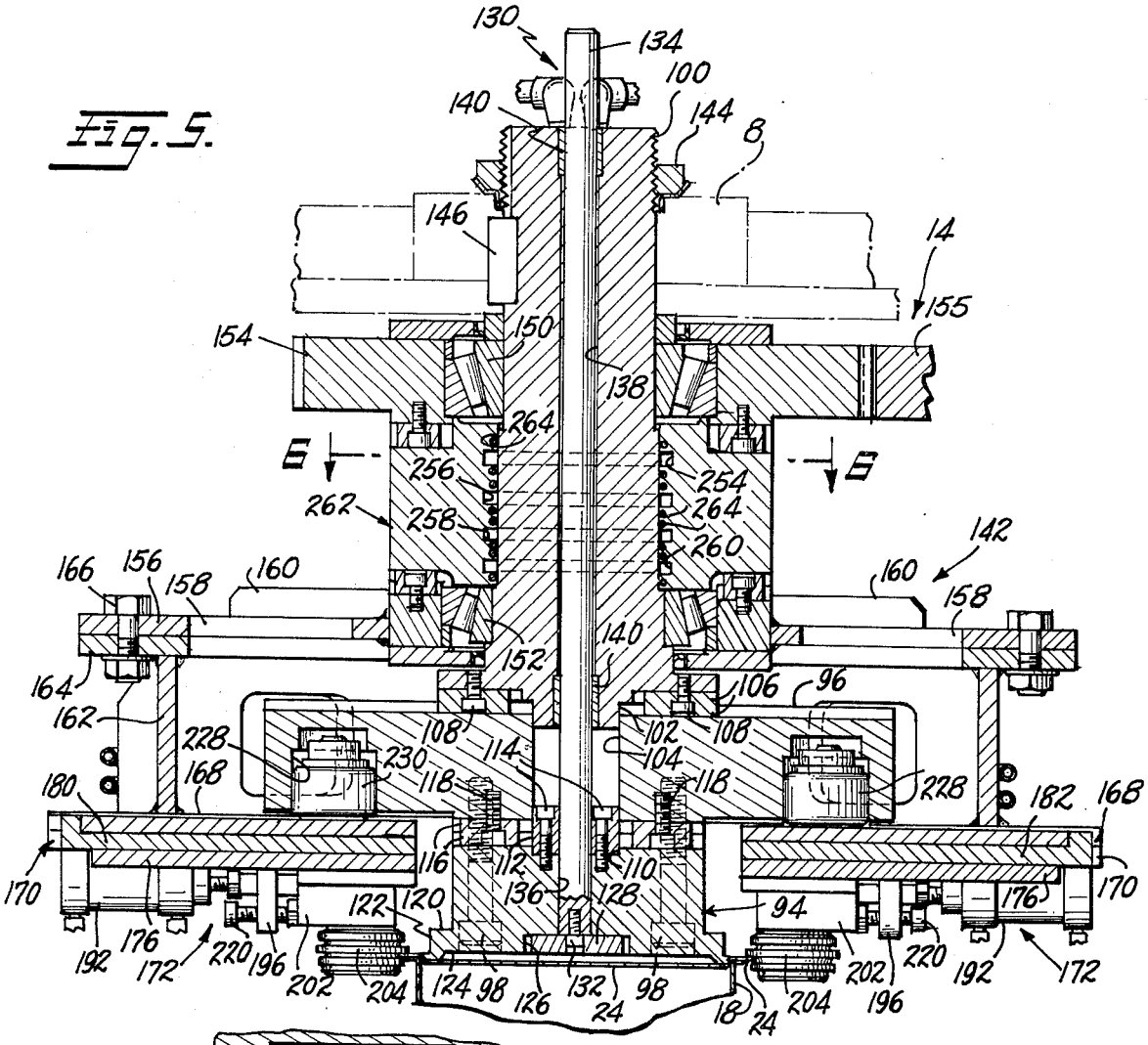
FIG. 5 is an enlarged vertical sectional view, taken through the seamer assembly of FIG. 4 generally along the line 5—5 of FIG. 2, and showing in particular how the rotating frame and the guide plate are mounted on a central supporting shaft carried by the frame of the seaming machine.
Figure 7:
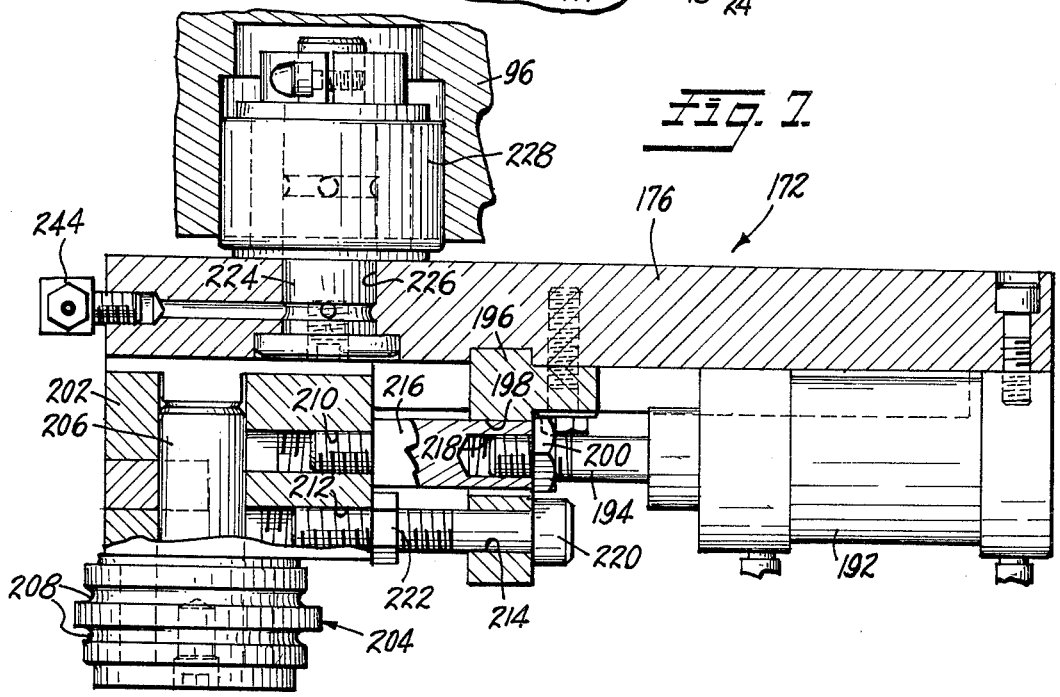
FIG. 7 is a fragmentary vertical sectional view through one of the seaming roller assemblies, showing the bracket, the slide with its attached seaming roller, the hydraulic actuating cylinder, and the top-mounted cam follower roller disposed within its cam track on the guide plate.
Figure 8:
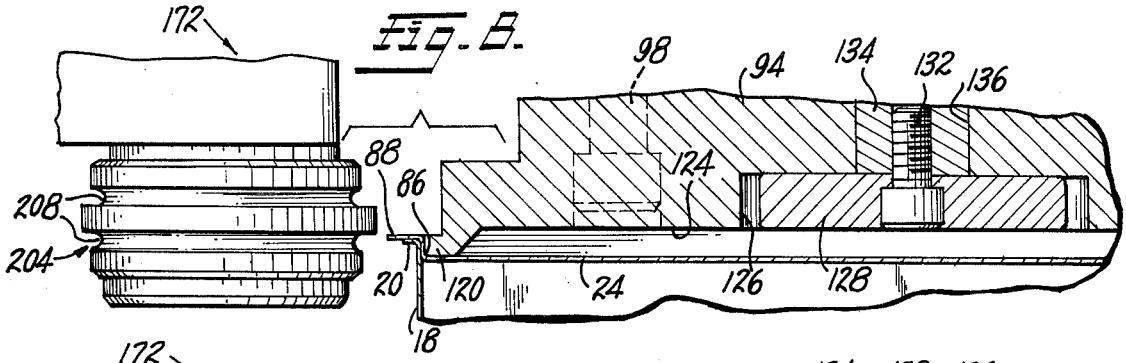
FIGS. 8 and 9 are enlarged fragmentary vertical sectional views illustrating how the first pair of seaming rollers engage the container and lid to form the first portion of the double joining seam therebetween.

Referring in particular to FIGS. 5 and 8, the chuck head 94 is secured to an annular guide plate 96 by bolts 98, the annular guide plate 96 in turn being secured by bolts (not shown) to the lower end of a central supporting shaft 100 carried by the upper machine frame assembly 8. The supporting shaft 100 has a reduced diameter portion 102 on the lower end thereof of a size to precisely fit within a central bore 104 in the guide plate 96, whereby centering of the guide plate is assured. Annular shim spacers 106 are disposed between the guide plate 96 and the lower end face of the supporting shaft 100, and are secured to the latter by screws 108, the shim spacers 106 being utilized to assure precise positioning of the guide plate 96.

The upper face of the chuck head 94 has a centrally disposed socket 110 therein, within which the lower end of an annular centering collar 112 is secured by bolts 114. The centering collar 112 is precisely fitted into the central bore 104 in the guide plate 96 whereby precise centering of the chuck head 94 is assured, and annular shim spacers 116 are secured to the lower face of the guide plate 96 by screws 118 to ensure proper vertical positioning of the chuck head. It is readily seen that both the guide plate 96 and the chuck head 94 can thus be easily removed and replaced, when necessary because of damage, or to adapt the machine to a different size container.

The lower end of the chuck head 94 has an external flange 120 thereon, of dimensions to fit snugly within the depression 86 formed in the lid 24. The peripheral wall 122 of the flange 120 is of sufficient vertical height to provide full back-up to the upper endwall of the container 18 during formation of the double seam joint of the invention, as shown in FIGS. 8–11. Inwardly of the flange 120 the chuck head 94 has a depression 124 therein, and centrally of the bottom wall of the depression 124 there is a socket 126 for seating the head 128 of a knockout piston assembly 130. The head 128 is secured by a bolt 132 to the lower end of a hydraulically-operated piston rod 134, which passes vertically upwardly through a central bore 136 in the chuck head 94, the centering collar 112, and an axial bore 138 extending through the supporting shaft 100. The axial bore 138 of the supporting shaft 100 has bushings 140 therein to ensure free movement of the piston rod 134, and the upper end of the piston rod 134 is engaged and moved in the usual manner by a hydraulic mechanism mounted on top of the frame assembly 8 (not shown) at the conclusion of the seaming cycle, to ensure removal of the completed container and lid assembly from the chuck head 94.

A rotatable frame assembly 142 is mounted on the supporting shaft 100, the latter being secured to the frame 8 by a lock nut 144 and a key 146 so that it is fixed in position against rotation. The frame assembly 142 includes a cylindrical collar assembly 148 mounted by upper and lower thrust bearings 150 and 152 on the supporting shaft 100, the upper end of the collar assembly 148 having a drive gear 154 attached thereto that is engageable by a power gear 155 to effect rotation of the frame assembly 142 about the supporting shaft 100.

A mounting plate 156 having openings 158 therein is secured to the lower end of the frame assembly 142, and is braced by gussetts 160 on its upper surface. A cylindrical ring 162 is secured to the lower surface of the mounting plate 156, the ring 162 having a mounting flange 164 on its upper end, the flange 164 being connected to the mounting plate 156 by bolts 166.

Welded to the lower end of the cylindrical ring 162 are four segment plates 168, spaced apart to define four radial ways 170 disposed 90° from each other. Mounted within a first pair of diametrically aligned ways 170 are two opposed seamer units 172, a second pair of opposed seamer units 174 being mounted in the other pair of diametrically aligned ways 170. The seamer units 172 and 174 are identically mounted and arranged, the first pair of units 172 functioning to form the first half of a double seam, and the second pair of units 174 functioning subsequently in the operating cycle to form the second portion of the double seam.

Because the seamer units 172 and 174 are identically mounted and arranged, only the units 172 will be described in detail.

Figure 2:
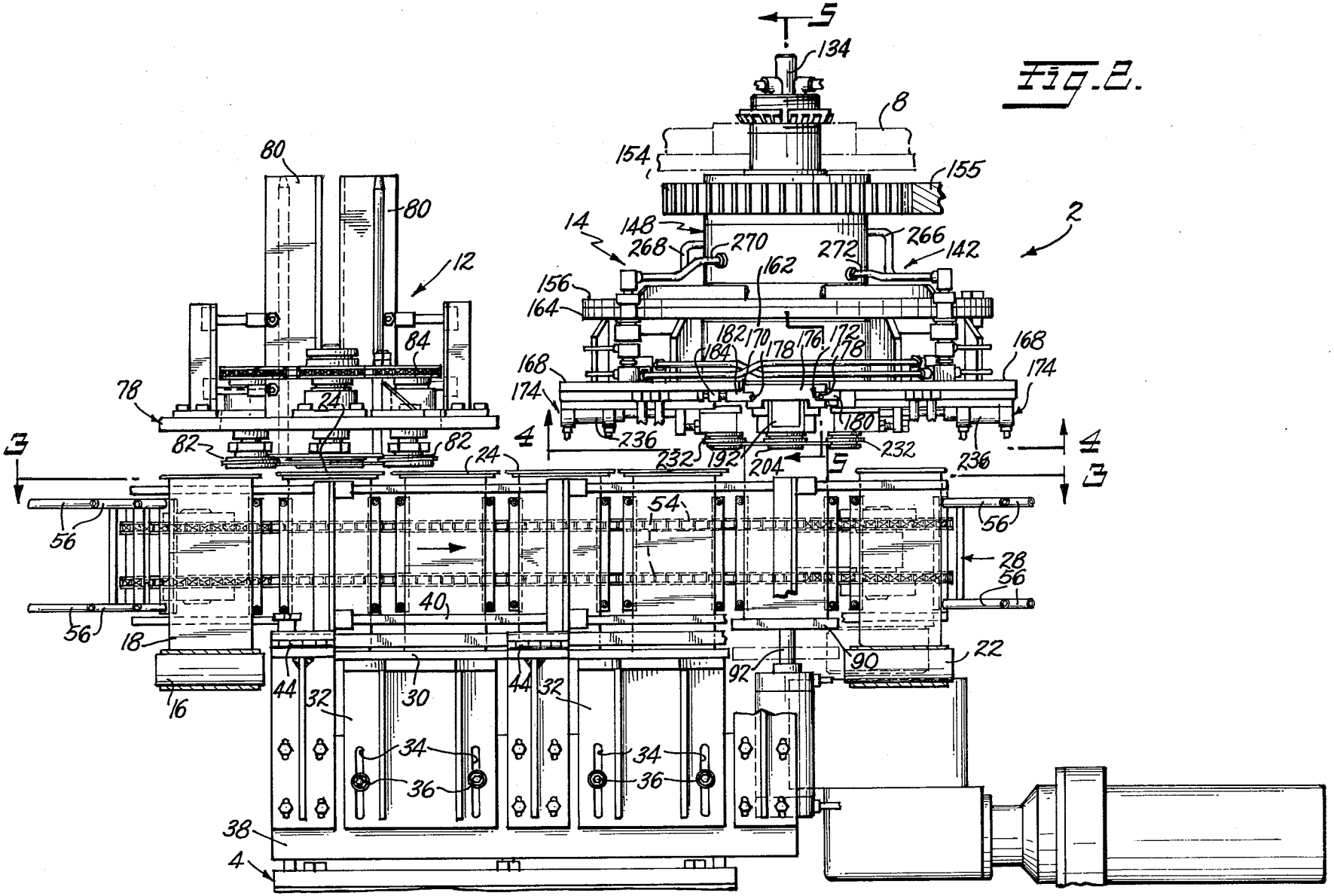
FIG. 2 is a fragmentary elevational view of the apparatus of FIG. 1, looking in the direction of the arrows 2—2 thereof, and with the sheet metal shields removed for purposes of showing the operating machinery.

Each of the seamer units 172 includes a bracket plate 176 having parallel grooves 178 formed in the opposite longitudinal sides thereof (FIG. 2). An L-shaped rail 180 is fixed to one of the segment plates 168 along one side of each way 170, and a similar L-shaped rail 180 fixed to one of the segment plates 168 along one side of each way 170, and a similar L-shaped rail 182 is mounted on the edge of the confronting segment plate 168 defining the same way 170. The L-shaped rail 182, however, is mounted for sliding movement toward and away from the L-shaped rail 180. A bar 184 is mounted outwardly of the rail 182, and carries tension bolts 186 that are engageable with the rail 182. The rails 180 and 182 are received in the parallel grooves 178 in the bracket plate 176, and serve to mount the seamer unit 172 for sliding movement back and forth in the way 170. The tension bolts 186 are utilized to eliminate play in the sliding seamer unit 172, to assure precision operation. It is evident from the construction described that the seamer units 172, and similarly the units 174, can be easily removed and replaced. The units 174 are mounted by rails 188 and 190 identical to the rails 180 and 182, respectively.

Each of the bracket plates 176 has a double-acting hydraulic cylinder 192 mounted on the outer end thereof, and provided with a piston rod 194. A stop bar 196 is mounted to the underside of the bracket plate 176 forwardly of the piston rod 194, the stop bar 196 having a central bore 198 therethrough in alignment with the piston rod. The outer end of the piston rod 194 is externally threaded, and carries a stop nut 200 thereon, positioned on the side of the stop bar 196 facing the cylinder 192. Thus, the adjustable stop nut 200 functions to limit the forward movement of the piston rod 194.

Disposed on the other side of the stop bar 196 from the cylinder 192 is a slidable mounting block 202 carrying a seaming roller 204, the seaming roller 204 being mounted on a shaft 206 and having the necessary seam-forming grooves 208 thereon required to make the first portion of a double seam. The mounting block 202 has a pair of parallel, vertically aligned threaded bores 210 and 212 therein, facing the stop bar 196, the bore 210 being in alignment with the central bore 198, and the stop bar 196 having a second bore 214 therein in alignment with the bore 212. The reduced outer, threaded end of a connector shaft 216 is secured in the threaded bore 210, the outer end of the connector shaft 216 having a threaded bore 218 therein for receiving the threaded outer end of the piston rod 194. Thus, the piston rod 194 is effective to move the seaming roller 204 back and forth longitudinally of the seamer unit 172.

To ensure precision sliding movement of the block 202 carrying the seamer roller 204, a guide bolt 220 passes through the second bore 214 in the stop bar 196, and is engaged in the threaded bore 212, the guide bolt having a stop nut 222 thereon.

Mounted on the upper face of the bracket plate 176 on a shaft 224 seated in a bore 226 provided in the plate 176 is a cam follower roller 228. The follower rollers 228 on the seamer units 172, and similar follower rollers 230 on the seamer units 174, function to move their respective seamer rollers 204 and 232 radially inwardly and outwardly as the frame assembly 142 is revolved about the rectangular container 18, this being accomplished by having the followers 228 and 230 received in a continuous cam track 234 provided in the lower face of the guide plate 96.

The seamer units 174 each include a double-acting hydraulic cylinder 236, the piston rods 238 of which function to move the seaming rollers 232 back and forth relative to the bracket plates 240 of said seamer units. The seaming rollers 232 have the necessary grooves 242 thereon to make the second half of the double seam.

In order to assure free movement of the cam follower rollers 228, lubrication fittings 244 are mounted on the bracket plates 176, and lead to the shaft 224. All of the sliding interfaces in the machine 2 are similarly provided with lubrication fittings, so that wear life is prolonged and smooth. Precision operation assured.

The four hydraulic cylinders 192 and 236 must of course be supplied with hydraulic fluid for operation, and to accomplish this the central supporting shaft 100 has four spaced longitudinal passages 246, 248, 250 and 252 therein, leading respectively to annular manifold grooves 254, 256, 258 and 260 provided in the central portion 262 of the collar assembly 148. The manifold grooves 254 through 260 are sealed from each other and against leakage by O-rings 264 carried in annular grooves in the collar portion 262, and are connected to their respective hydraulic cylinders by conduits 266, 268, 270 and 272, and associated fittings. The upper end of each passage 246 through 252 is connected to the master control panel of the machine, and thence to a source of hydraulic fluid.

As shown in FIG. 1, in order to protect workmen from the moving elements of the machine 2, the rotating assembly 142 is covered by a sheet metal shield 274, and similar shields are provided to cover other moving components. The shields are all removed in the balance of the FIGS., so as to clearly show the components of the machine.

Figure 14:
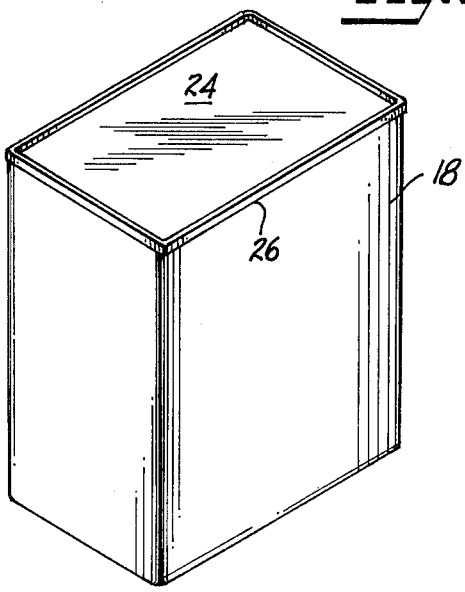
FIG. 14 is a perspective view of a rectangular container with a lid joined thereto by a double seam joint made by the machine of FIGS. 1–11.

The seaming machine 2 of FIGS. 1–11 is intended to function with rectangular containers 18, to produce a finished and sealed container 18 as shown in FIG. 14. The manner in which the machine operates will now be reviewed, although it is believed such is apparent from the description that has already been given.

Open containers 18 are supplied on the conveyor 16 to the transfer mechanism 28, the containers being picked up by the fingers 56 and moved along the shelf 30, as has been described. The first operating station reached is the lid dispenser 12, which functions as described to place a single sheet metal lid 24 in place on the open container. The container is then moved along to its second operating station, to come to rest on the base plate 90. The actual seaming cycle is then commenced, such being controlled by the usual control circuit utilized in machines of the present type. Since such a control circuit is easily devised and not important to the inventive features of the invention, it will not be detailed herein.

The operating sequence of the seaming cycle is as follows. First, the base plate 90 is elevated by the piston rod 92, to clamp the chuck head 94 against the lid 24, with the peripheral lip 122 of the flange 120 received in the depression 86 of the lid so that it backs up the cylindrical upper edge of the container 18. The flange or lip 88 of the lid 24 projects outwardly over the flange 20 of the container 18, all as shown in FIG. 8.

Figure 9:
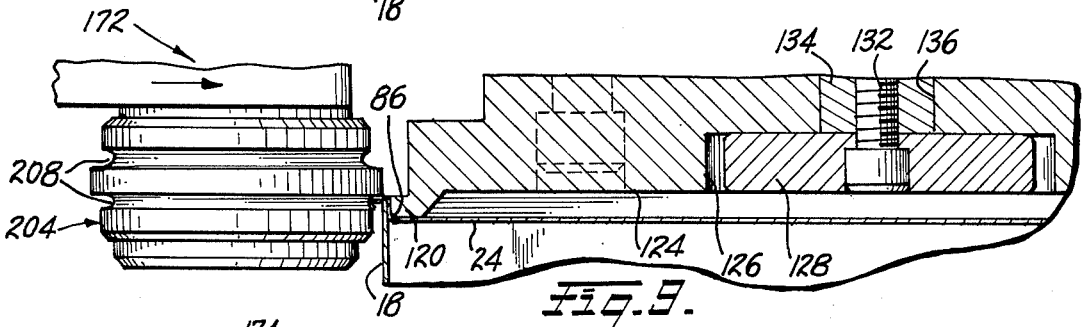

The hydraulic cylinders 192 of the seamer units 172 are then activated to move their associated seamer rollers 204 inwardly, as shown in FIG. 9, and assembly 142 is then rotated by applying force to the drive gear 154. When the assembly 142 rotates, the cam followers 228 track around the cam track 234, thereby following the generally rectangular periphery of the container 18, the seamer rollers 204 then functioning to form the first portion of the double seam. When the first portion of the seam is complete, the hydraulic cylinders 192 are activated in the opposite direction, to retract the seamer rollers 204.

It is here again noted that the degree of pressure exerted by the seamer rollers 204 is easily controlled, merely by controlling the hydraulic pressure supplied to the hydraulic cylinders 192. Thus, a truly universal range of operating pressures is available, in sharp contrast to seaming machines of the past. The ultimate inward movement of the seamer rollers 204 is of course checked by the stop nuts 222, which are also universally moveable along the threaded piston rods 194.

Similarly, the speed with which the seam is formed is easily controlled, merely by varying the speed of the drive gear 154. Thus, for the first time total control over both the pressure of seaming, and the speed of the seaming operation, is available with the invention.

It should be noted, as is apparent from FIG. 4, that the cam track 234 is not completely rectangular, but rather that the sides thereof are somewhat bowed. This is deliberate. As has been noted, the sidewalls of rectangular containers 18 are normally bowed when they enter the machine 2, and some straightening thereof is accomplished by the fingers 56. However, despite the straightening provided by the fingers 56, the container sidewalls will still be somewhat bowed as the containers reach the seaming station. It has been found that the use of a bowed cam track 234 will accommodate such initially bowed rectangular containers; the containers are ultimately made rectangular in the seaming operation, as the hydraulically-biased seaming rollers 204 press against the rectangular peripheral wall 122 of the chuck flange 120 from opposite sides of the container. Thus, another feature of the invention obtained by the unique mounting for the seamer units 172 and 174 is the ability to ultimately square the bowed sides of a rectangular container, during rather than separately from a seaming cycle.

Figure 10:
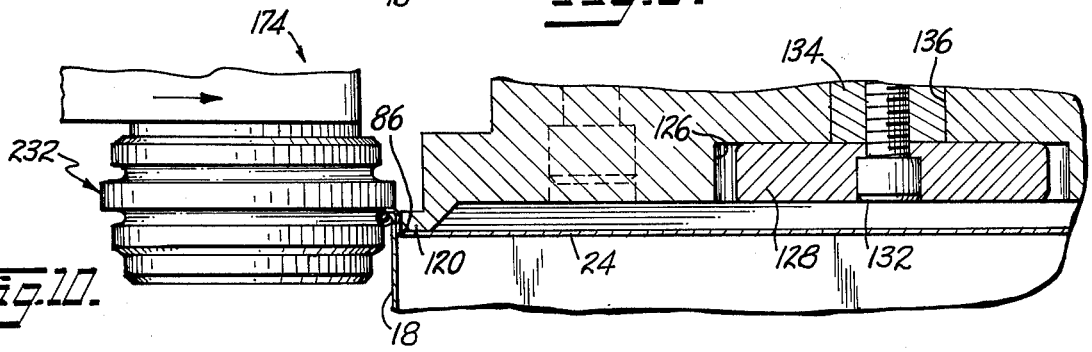
FIG. 10 is an enlarged fragmentary vertical sectional view illustrating how the second pair of seaming rollers engage the container and lid to form the final portion of the double joining seam.
Figure 11:
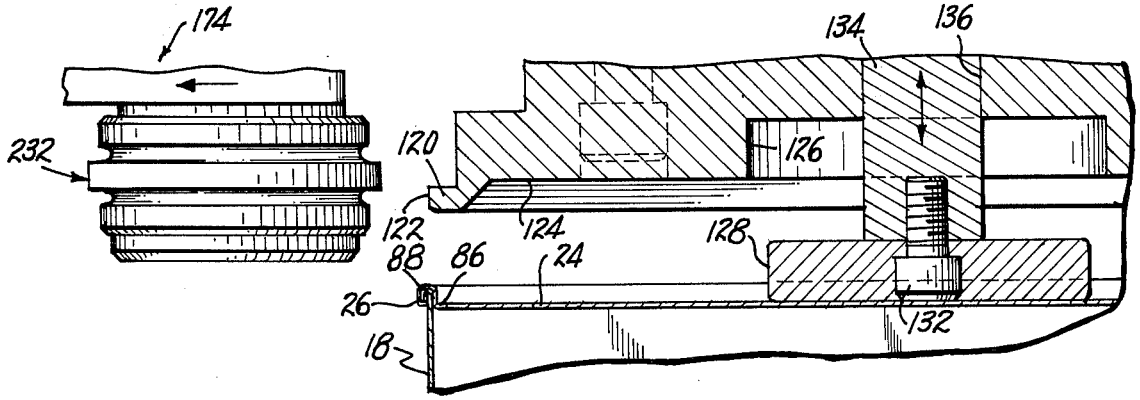
FIG. 11 is an enlarged fragmentary vertical sectional view showing how the knockout piston carried by the chuck head functions to disengage the sealed container from the chuck head.

After the seaming rollers 204 have been retracted, the other oppositely disposed set of seaming rollers 232 is activated by supplying hydraulic pressure to their associated hydraulic cylinders 236. The seaming rollers 232 then function in a manner analogous to the rollers 204, and as shown in FIG. 10, to complete the double seam. The rollers 232 are then withdrawn, and the base plate 90 is lowered to its position level with the shelf 30. The knockout piston assembly 130 is then activated, as shown in FIG. 11, to ensure release of the completed container from the chuck head 94. The seaming cycle is then complete, and the completed container 18 is moved out of the machine along the tray 22.

Figure 12:
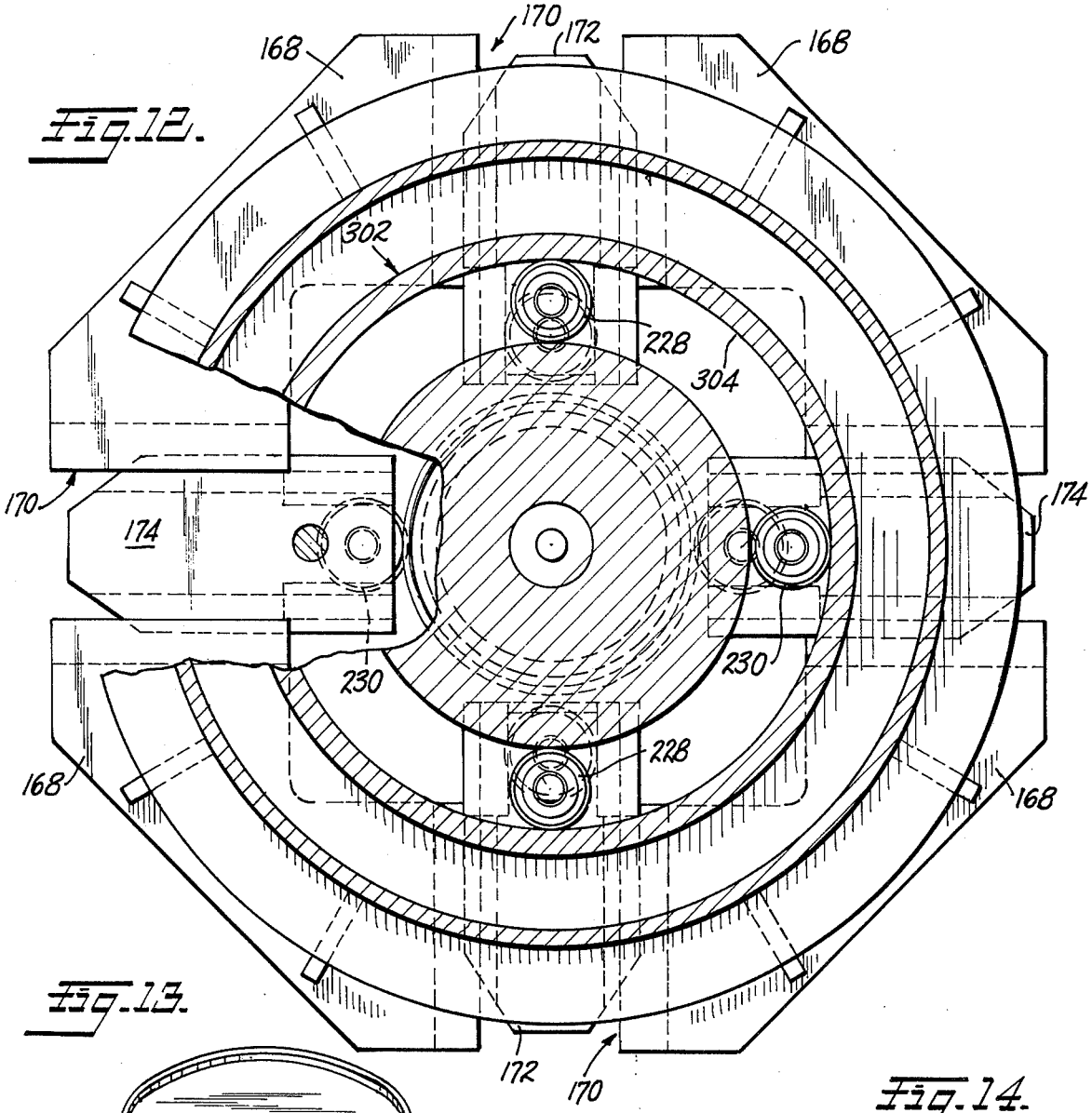
FIG. 12 illustrates a modified seaming assembly, designed with a circular cam track for seaming a circular container body.
Figure 13:
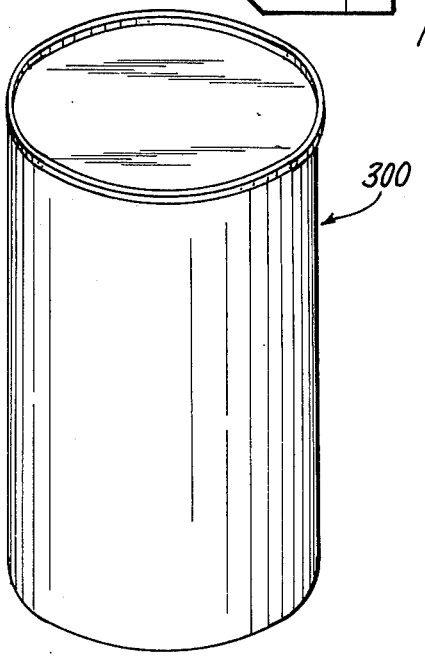
FIG. 13 is a perspective view of a completed circular container with a lid joined thereto by a double seam joint made by the machine of FIG. 12.

While the present invention is uniquely adapted to seaming closed rectangular containers, with modification it is also usable to seam closed cylindrical containers like that shown at 300 in FIG. 13. In order to accommodate cylindrical containers, all that is necessary is to substitute a new guide plate 302 like that shown in FIG. 12, for the guide plate 96. The guide plate 302 is similar to the guide plate 96, except that the cam track 304 thereof is circular. The functioning of the machine of FIG. 12 is otherwise similar to that described earlier.

The invention has been described in connection with making a double seam joint. Obviously, it can also be utilized to make a single seam joint, using different seaming rollers, and just one set of the seamer units. Other like modifications are possible.

Obviously, many modifications and variations of the invention are possible, without departing from the invention as shown and described.

I claim:

1. A seaming machine for securing a lid to an open container, said machine including: chuck means; means for clamping said open container against said chuck means, with said lid between said open container and said chuck means; a frame assembly mounted to revolve about said chuck means; means connected with said frame assembly for effecting revolution thereof about said chuck means; at least one pair of oppositely disposed bracket means carried by said frame assembly, said bracket means being disposed on opposite sides of said chuck means, and being reciprocally slidable relative to said frame assembly toward and away from said chuck means; guide means engaged with said reciprocally slidable bracket means, and effective to guide said slidable bracket means along a given path as said frame assembly is revolved about said chuck means; seamer roller means reciprocally mounted on each of said bracket means, for movement relative to its associated bracket means toward and away from said chuck means; and hydraulic means connected between each bracket means and the seamer roller means associated with said bracket means, operable independently of said means for effecting revolution of said frame assembly to move said associated seamer roller into and out of engagement with the periphery of said lid, and adjustable universally over a given range to exert a selected pressure on said lid periphery for forming a seam.

2. A seaming machine as recited in claim 1, wherein said hydraulic means operable for moving said associated seamer roller means into and out of engagement with the periphery of said lid includes a double acting hydraulic cylinder connected at one end to said bracket means, and at its other end to said seamer roller means.

3. A seaming machine as recited in claim 1, wherein said means connected with said frame assembly for effecting revolution thereof about said chuck means is universally adjustable over a given range of revolving speeds.

4. A seaming machine as recited in claim 1, wherein said machine further includes: a shelf extending underneath said chuck means, for receiving containers thereon; and transfer means for moving containers along said shelf.

5. A seaming machine as recited in claim 4, wherein said machine further includes: lid dispensing means positioned along said shelf before said chuck means, and adapted to place a single lid on each container moving therebeneath.

6. A seaming machine as recited in claim 1, wherein said guide means includes: a guide plate mounted above said slidable bracket means, and having a continuous cam track therein; and cam follower means on each of said bracket means, said cam follower means being received in said cam track, and said continuous cam track defining a configuration generally like the cross-sectional configuration of said container.

7. A seaming machine as recited in claim 6, wherein said cam track is generally rectangular in configuration, the corners of said rectangle being rounded, and the sides thereof being bowed outwardly.

8. A seaming machine as recited in claim 7, wherein said transfer means includes: a pair of vertically spaced, horizontally disposed endless chains, each having outwardly projecting fingers thereon adapted to engage containers disposed on said shelf; and means to effect revolution of said endless chains.

9. A seaming machine as recited in claim 1, wherein said means for clamping said open container against said chuck means comprises a hydraulically operable base plate disposed directly beneath said chuck means, and operable to move vertically toward and away from said chuck means, and wherein said chuck means further includes knockout means to ensure removal of a completed container therefrom.

10. A seaming machine as recited in claim 5, wherein said machine includes two pair of said bracket means, each having a seamer roller thereon and an individual double acting hydraulic cylinder for operating said roller, said seamer rollers being sequentially operational in opposed pairs during an operating cycle to form a double seam.

11. In a seaming machine for securing a lid to an open container, including chuck means, means for clamping said open container against said chuck means with said lid between said open container and said chuck means, a frame assembly mounted for relative revolving motion about said chuck means, and drive means for effecting relative revolution between said frame assembly and said chuck means, seamer means carried by said frame assembly and operable independently of said drive means to engage the periphery of said lid with a selected pressure for forming a seam during relative revolution of said frame assembly and said chuck means, said seamer means comprising: at least one pair of oppositely disposed bracket means carried by said frame assembly, said bracket means being disposed on opposite sides of said chuck means, and being reciprocally slidable relative to said frame assembly toward and away from said chuck means; guide means engaged with said reciprocally slidable bracket means, and effective to guide said slidable bracket means along a given path as said frame assembly is relatively revolved about said chuck means; seamer roller means reciprocally mounted on each of said bracket means, for movement relative to its associated bracket means toward and away from said chuck means; and means connected between each bracket means and the seamer roller means associated with said bracket means, operable independently of said drive means to move said associated seamer roller into and out of engagement with the periphery of said lid, and adjustable universally over a given range to exert a selected pressure on said lid periphery for forming a seam.

12. In a seaming machine as recited in claim 11, wherein said means operable for moving said associated seamer roller means into and out of engagement with the periphery of said lid includes a double acting hydraulic cylinder connected at one end to said bracket means, and at its other end to said seamer roller means.

* * * * *